US006845642B2

(12) United States Patent
Imedio Ocaña

(10) Patent No.: US 6,845,642 B2
(45) Date of Patent: Jan. 25, 2005

(54) CLUTCH MECHANISM FOR ELECTRONIC LOCKS

(75) Inventor: Juan Antonio Imedio Ocaña, Fuenterrabia (ES)

(73) Assignee: Escudos Kala Internacional S.L., San Sebastian (ES)

( * ) Notice: Subject to any disclaimer, the term of this patent is extended or adjusted under 35 U.S.C. 154(b) by 0 days.

(21) Appl. No.: 09/752,913

(22) Filed: Jan. 2, 2001

(65) Prior Publication Data

US 2001/0005998 A1 Jul. 5, 2001

(30) Foreign Application Priority Data

Dec. 31, 1999 (ES) ..... 9902891

(51) Int. Cl.[7] ..... E05B 47/00
(52) U.S. Cl. ..... 70/277; 70/472; 70/222
(58) Field of Search ..... 70/472, 188, 189, 70/422, 222, 223, 218, 277; 292/DIG. 27

(56) References Cited

U.S. PATENT DOCUMENTS 4,956,984 A * 9/1990 Chi-Cheng ..... 70/277
5,018,375 A * 5/1991 Tully ..... 292/144
5,475,996 A * 12/1995 Chen ..... 70/218
5,732,580 A * 3/1998 Garnault et al. ..... 70/360
5,934,117 A * 8/1999 Shen ..... 70/149
5,960,656 A * 10/1999 Yao ..... 70/223
6,021,654 A * 2/2000 McCaa ..... 292/336.3
6,041,630 A * 3/2000 Shen ..... 70/149
6,189,351 B1 * 2/2001 Eagan et al. ..... 292/DIG. 27
6,334,348 B1 * 1/2002 Ming-Chih ..... 292/DIG. 27

* cited by examiner

*Primary Examiner*—Chuck Y. Mah
*Assistant Examiner*—Michael J. Kyle
(74) *Attorney, Agent, or Firm*—Klauber & Jackson

(57) ABSTRACT

This mechanism is intended for being located in the inner escutcheon of the lock and its purpose is to minimize the forces transmitted, thereby preventing premature wear, as well as being able to be adaptable to any lock. Its structure permits to minimize the turning of the handle or outer operating knob under no load.

The outer escutcheon (3) holds the key reader (4) and an outer knob (5) while the inner escutcheon (6) contains the electronic control circuit (7) powered by batteries (8), the clutch mechanism (9) and an inner operating knob (10). Exiting from the clutch mechanism (9) are two concentric shafts (21, 26), one of which acts on the tumbler (2) of the lock and the other (26) which rotates freely in its interior and to which the outer knob (5) is connected.

A validated key activates an electric motor (51) or similar which displaces a collar (28) causing the clutch element (27) to bring both concentric shafts (21, 26) together temporarily, forming a single unit and permitting the opening of the lock.

6 Claims, 7 Drawing Sheets

CLUTCH MECHANISM FOR ELECTRONIC LOCKS

OBJECT OF THE INVENTION

This invention, according to the statement of this description, comprises a clutch mechanism for electronic locks, which involves notable relevant and advantageous characteristics compared to those currently used for the same purpose.

It is an object of the invention to incorporate the clutch mechanism inside the inner escutcheon of a lock and thereby permit to be used with a wide range of mortise locks, even with locks that are already installed.

The placement inside the inner escutcheon provides the advantages of greater security and better aesthetics:

Greater security since it is protected against manipulation from the outside and against adverse climatic conditions; and better aesthetics since the outer escutcheon does not need any extraordinary dimensions for housing the clutch mechanisms.

BACKGROUND OF THE INVENTION

Electronic locks are characterised in that they have a mechanical lock that physically secures the door to the frame and having certain electronic means for authorising the use of that lock. The electronic means include a reader that permits to read data from a coded medium that can take different forms and different technologies, such as for example a magnetic card, a proximity card or a key with memory. We will in general name these coded media as keys. When a key with valid data is presented, the electronic control permits the outer handle to operate one of the shafts of the mechanical lock, either by means of releasing a latch that was preventing the handle from turning or by means of activation of a clutch that connects the shaft of the handle to the shaft of the lock.

Mechanical locks can have one or several shafts. Some open the catch bolt and are usually operated by a handle or knob. Others close or open a lever and are usually operated by means of cylinder, either with a key, or with a rotating knob. Electronic control can govern the action of one or several of the shafts depending on the applications of the lock. In the description that follows, we do not distinguish between one and another shafts, nor between handles and knobs, using instead the generic term handle.

Solutions based on a latch, though they are simpler, are less secure than those based on a clutch since the latch has to resist all kinds of stresses that are applied to the handle when an attempt is made to force it, while the clutch simply does not transmit those stresses to the lock.

Moreover, the handle in the inner side of the door must always open the lock in order to permit exit in cases of emergency, without the intervention of any electronic control. This feature is called anti-panic.

There are numerous patents on clutch mechanisms for electronic locks housed in the outer escutcheon and which connect the shaft of the outer handle to the shaft that operates the lock, which is permanently connected to the inner handle.

One improvement is to locate the clutch in the inside of the door rather than in the outside. This is a more secure solution since the clutch is then protected from possible manipulations. It is more reliable from the environmental point of view since the inner side usually suffers smaller variations in temperature and humidity. It can also be more aesthetic since the outer escutcheon does not have to house the clutch mechanism.

Patent EP 0 819 810 claims a clutch placed in the inner escutcheon and which actuates the lock via two concentric shafts. The first shaft is connected to the outer handle. The second shaft is connected to the inner handle and to the tumbler of a modified cylinder via which it opens the lock.

When installing the lock, the first shaft is inserted inside the second shaft freely rotating inside it.

For engaging the clutch of both shafts, a piece moves axially, projecting a clutch plate via a slot in the second shaft within a groove in the first shaft. In this way, the two shafts become coupled and permit the outer handle to open the lock.

The problems that appear are due to the necessarily small diameter of the shafts so that they can be compatible with standard locks.

The tumblers of mechanical locks have standardised cross-sections and are usually square with sides of between 7 and 9 mm. The diameters of the concentric shafts that are described can at most be equal to those dimensions in the case of the second shaft and less than those in the case of the first shaft.

The first problem is a consequence of the stresses borne by the mechanism. When the clutch is operated the stress suffered by the plate, the slot of one shaft and the groove of the other is equal to the drive torque of the lock divided by the radius of the shafts. As this radius is very small, the stress is very great and wear takes place very quickly.

The second problem is also caused by the small diameter of the first shaft, which involves that it cannot have more than two slots in order to keep its strength within acceptable minima, since each slot reduces its cross-section. When the clutch is engaged, coupling does not occur between the two shafts until the slot of the second shaft is faced to the one of the grooves of the first shaft. It may therefore be necessary to turn the outer handle under no load up to 180°, which produces an uncomfortable sensation for the user.

DESCRIPTION OF THE INVENTION

In general terms, the clutch mechanism for electronic locks, constituting the object of the invention, solves both problems referred to above and maintaining the advantages of being located inside the inner escutcheon and of being able to be adapted to any lock since the actuation shafts have standard dimensions.

By means of a totally different configuration of the clutch, the advantage is achieved that the stresses suffered by the interacting parts are the least possible and that the rotation of the outer handle under no load is minimised. Furthermore it permits a very simple assembly.

The electronic lock includes an outer escutcheon that holds the key reader and an outer control knob for operating the lock systems. The inner escutcheon contains the electronic control circuit powered by batteries, the clutch mechanism and an inner operating knob.

The clutch mechanism has two concentric shafts, one of which acts on the tumbler, while the other freely rotates with respect to the first when it is driven by the outer knob with which it is integral. The knob or inner control is integral to the first shaft.

Both concentric shafts are made integral when turning by means of the operation of the clutch via an electric motor governed by a control device connected to the key reader.

There exist two follower pieces, one outer and the other inner, which engage together by means of castellated projections, existing a cavity between them in which the clutch piece freely rotates. The periphery of that clutch piece presents notches which are suitable for the insertion of axial projections from a coupling piece that defines the axially displaceable element. These projections previously cross through the inner follower, which is provided with the appropriate openings for that purpose. The coupling piece is displaced by means of a yoke and the displacement is guided in the cylindrical periphery of an inner shaft integral to the inner square bar operated by the inner knob.

When the mechanism is disengaged, the coupling piece is retracted and the projections of that piece do not touch the clutch and therefore no movement is transmitted to the tumbler.

When the mechanism engages the clutch, the coupling piece is located in the most advanced position and the projections of that coupling piece mentioned earlier remain inserted in the respective notches of the clutch which causes the concentric shafts to rotate integrally when the outer knob is turned.

In order to facilitate an understanding of the characteristics of the invention and forming an integral part of this description, attached are some sheets of plans in whose figures the following is represented by an illustrative and non-restrictive way:

DESCRIPTION OF AN EMBODIMENT OF THE INVENTION

Figure 1:
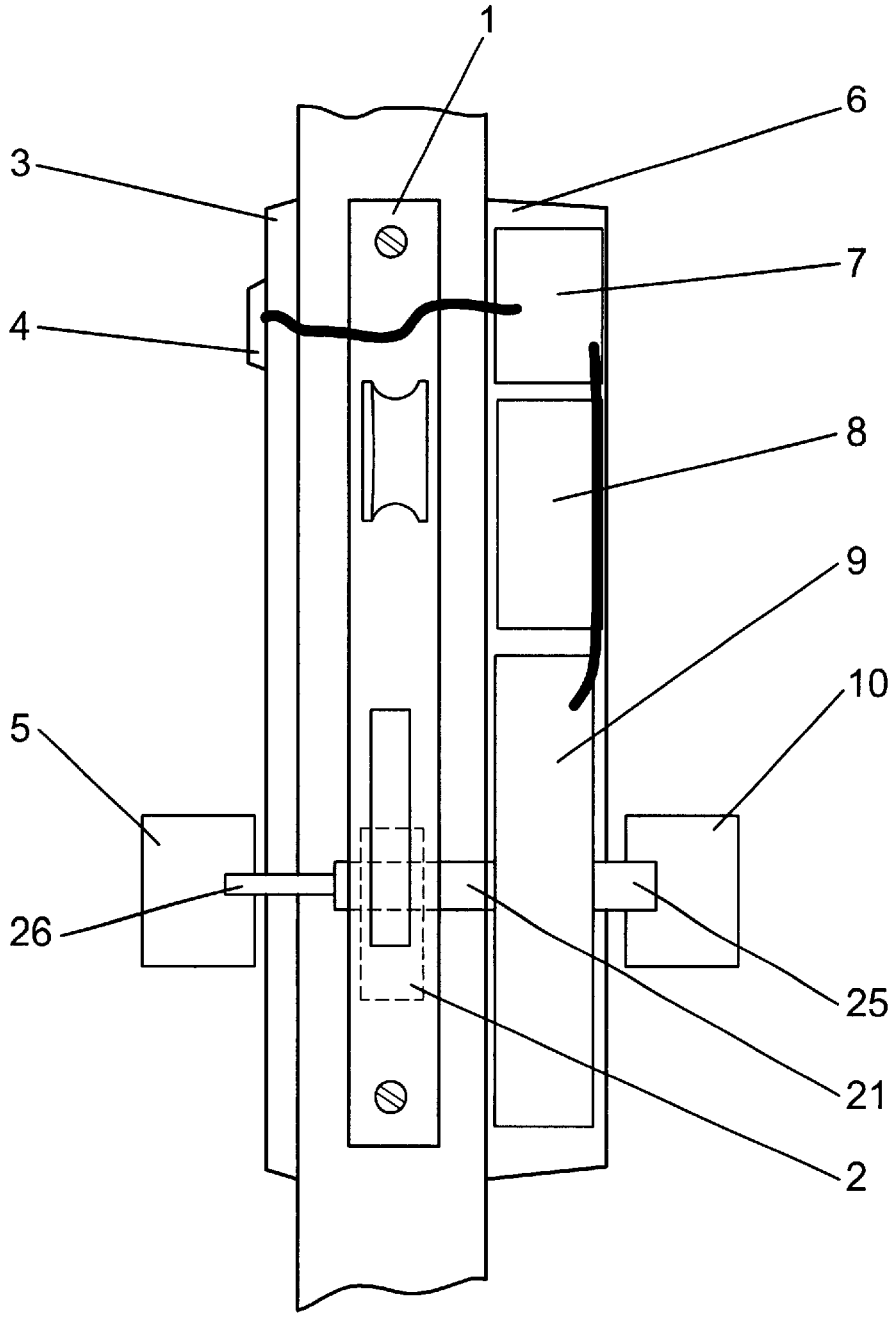
FIG. 1.—Is a schematic view in front elevation of a mortise lock placed in a door, including the clutch mechanism which is the object of the invention.

Referring to the numbering system adopted in the figures and in particular to FIG. 1, we can see how the clutch mechanism for electronic locks, which the invention proposes, is fitted in a mortise lock 1 in which, when rotating the tumbler 2, the lever and catch bolt are moved.

The electronic lock comprises two escutcheons: the outer escutcheon 3 which holds the key reader 4 and an outer knob 5; and the inner escutcheon 6 which contains the electronic control circuit 7 powered by batteries 8, the clutch mechanism 9 and an inner knob 10.

Projecting from the clutch mechanism 9 are two concentric shafts 21 and 26. The first shaft 21 acts on the tumbler 2 of the lock. The second shaft 26 rotates freely inside the first shaft and is partially inserted inside the outer knob 5 rotating integral to it.

The inner knob 10 always operates the lock since by means of various pieces it is integral to the shaft 21 which acts on the tumbler 2.

The key reader 4 is electrically connected to the control 7. When a valid key is presented, the control supplies power to the clutch mechanism motor by means of wires, making the shafts 21 and 26 integral for a few seconds and permitting the outer knob 5 to open the lock.

The configuration represented in this FIG. 1 is given by way of an example and in it neither the type of key reader used nor the exact arrangement of the mortise lock are important. A European type of mortise lock has been represented in which the shaft that drives the lever is actuated, though it could also be the shaft that drives the catch bolt or it could be an American lock or a single-shaft lock for operating a catch bolt or a lever.

Figure 2:
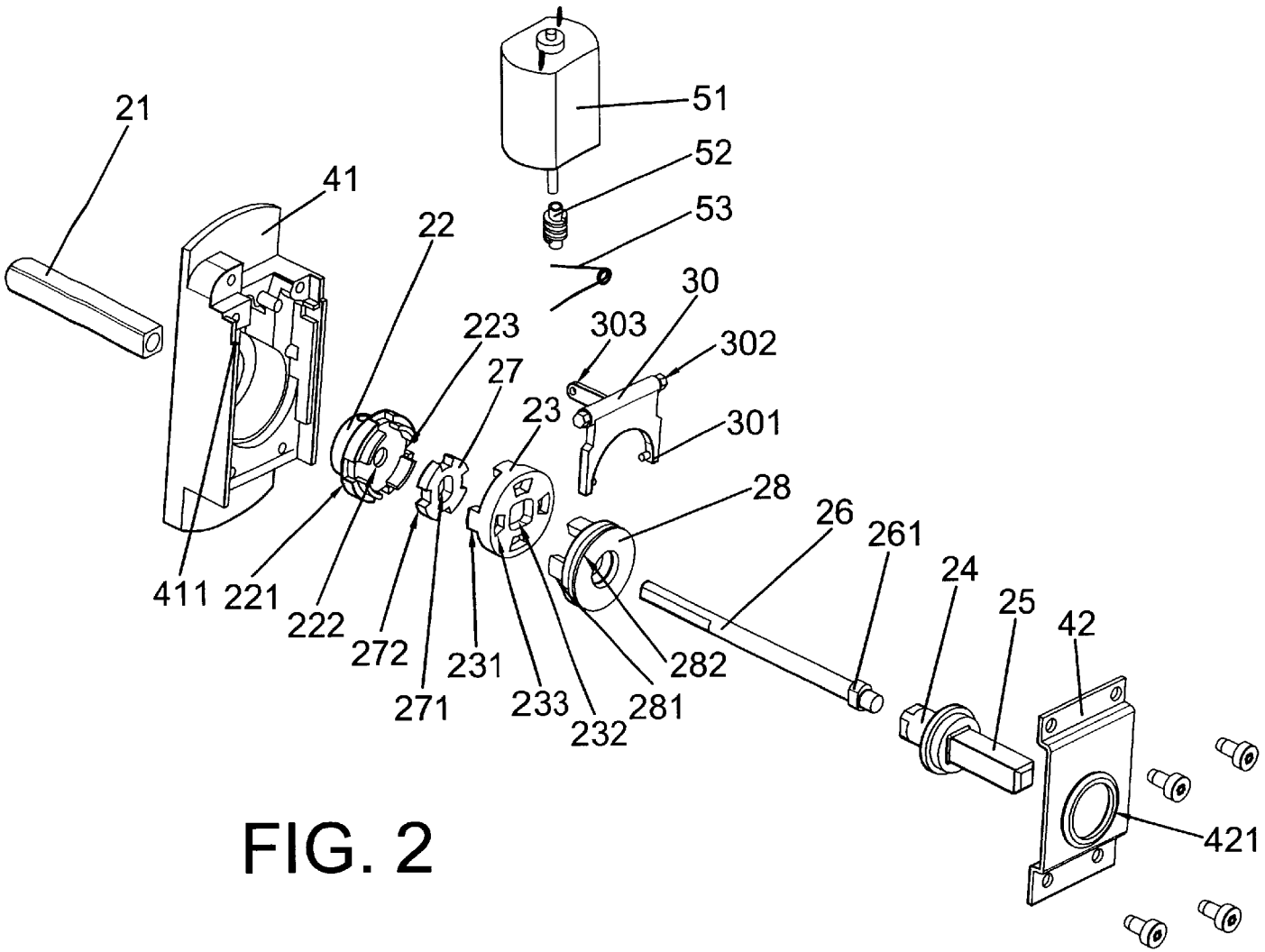
FIG. 2.—Is a detailed view of the exploded parts of the clutch mechanism.
Figure 2A:
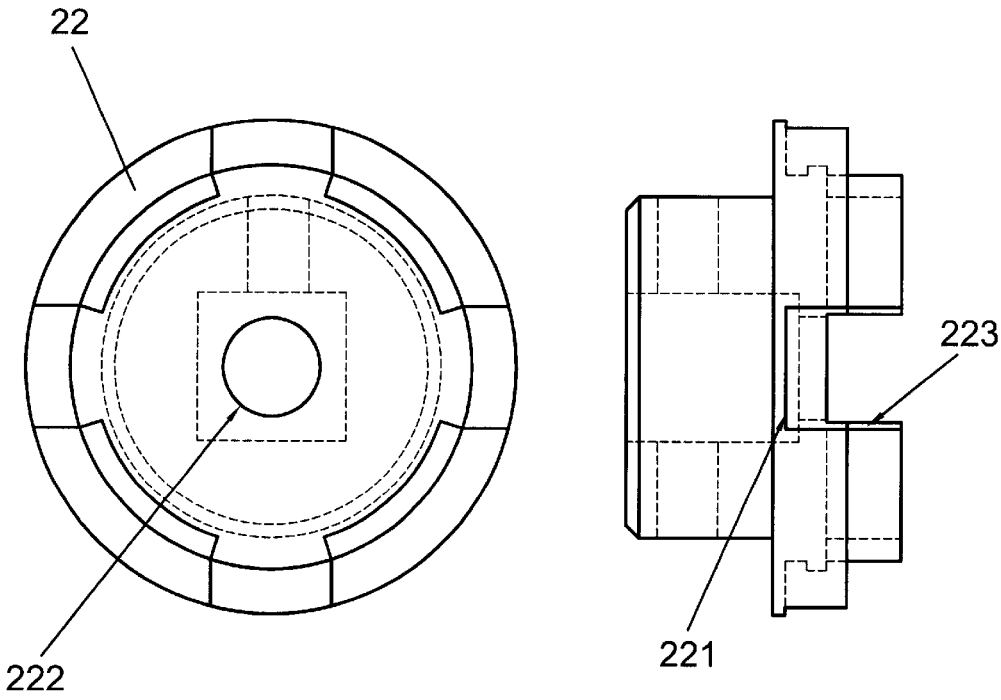
FIG. 2*a*.—Represents the front elevation and side elevation view of the outer follower piece, in accordance with that is shown in FIG. 2.
Figure 2B:
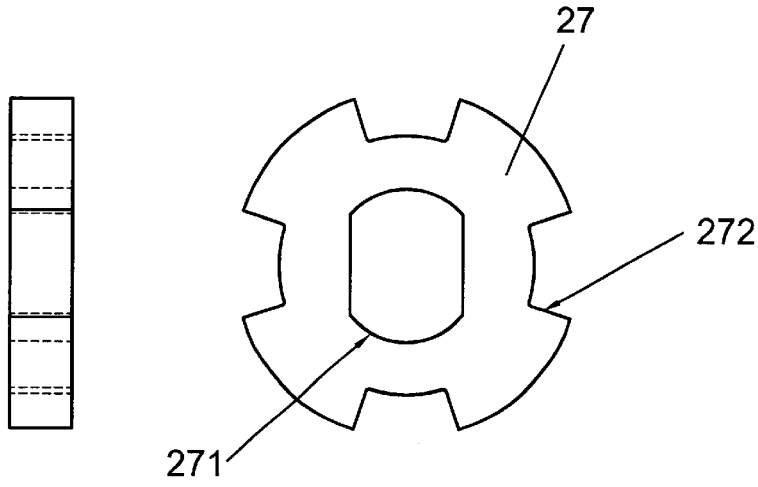
FIG. 2*b*.—Represents another two views of the clutch elements, in accordance with that is shown in FIG. 2.
Figure 2C:
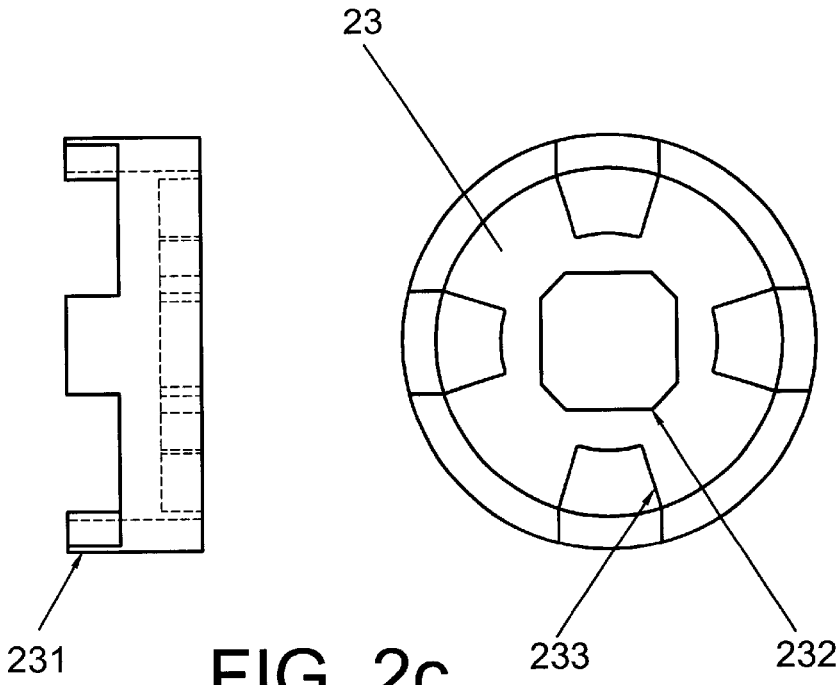
FIG. 2*c*.—Represents another two views of the inner follower piece, in accordance with that is shown in FIG. 2.
Figure 2D:
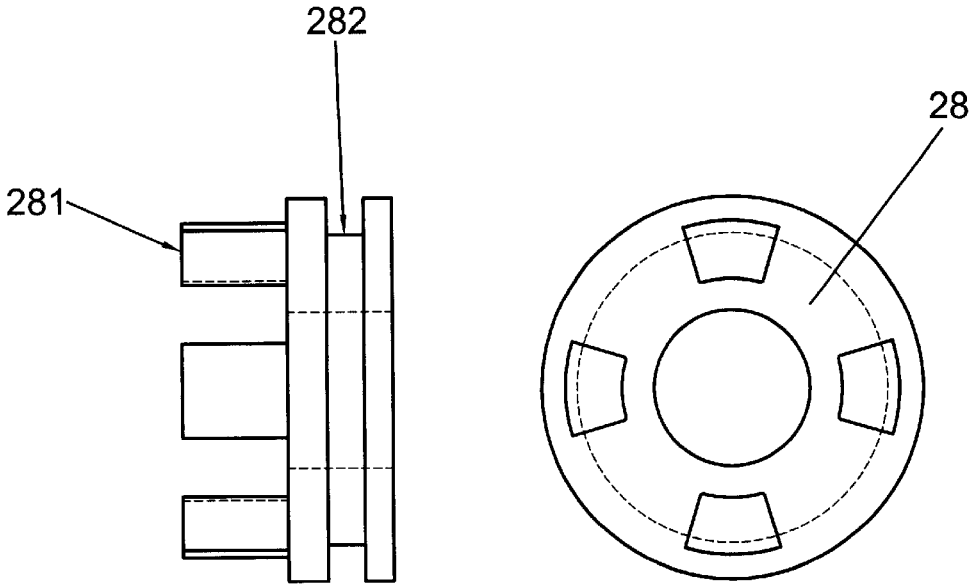
FIG. 2*d*.—Represents another two views of the coupling piece, in accordance with that is shown in FIG. 2.

Making special reference now to FIG. 2 representing an exploded diagram of the clutch mechanism, it can be seen that the first shaft 21 is fitted to the outer follower 22 by means of a square housing and a radial screw (see also FIG. 2*a*). The outer follower 22 and the inner follower 23 catch together by means of some castellated projections 221 and 231, forming in their interior a cavity in which the clutch element 27 freely rotates. This element presents four notches 272 in its periphery in the example of embodiment shown.

The second shaft 26 is found inside the first shaft 21 and crosses through the outer follower 22 when passing through the opening 222 of the latter and it presents a thickening 261 that is housed in the hole 271 of the clutch element 27, both with a cross-section showing two flat faces so that they can rotate together.

The inner square bar 25 is mounted on an inner shaft 24 showing flat faces that are complementary to an open recess 232 in the inner follower 23. The assembly formed from the first shaft 21, outer follower 22 and inner follower 23, inner shaft 24 and inner square bar 25 rotates as a whole and are kept together because the box 41 and the cover 42 keep all the pieces at a fixed length thanks to the projections of the outer follower 22 and of the inner shaft 24 which have a larger diameter than the holes 411 and 421.

Nevertheless, the assembly formed by the second shaft 26 and the clutch element 27 rotate freely but cannot move axially because they are restricted in their movements by the arrangement of the pieces described above.

The coupler 28 is a piece that can slide axially on the inner shaft 24 and has four projections 281 which traverse the inner follower 23 through four holes 233 and which are also housed in the grooves 223 of the outer follower 22. The outline of these projections 281 matches that of the notches 272 of the clutch element 27.

The cylindrical periphery of the coupling piece 28 has an annular groove 282 in which are housed two projections 301 of the yoke 30. This yoke 30 can oscillate around its axis 302 acting on its arm 303. The electric motor 51 moves that arm 303 via a spring 53 and a endless screw 52.

Figure 3:
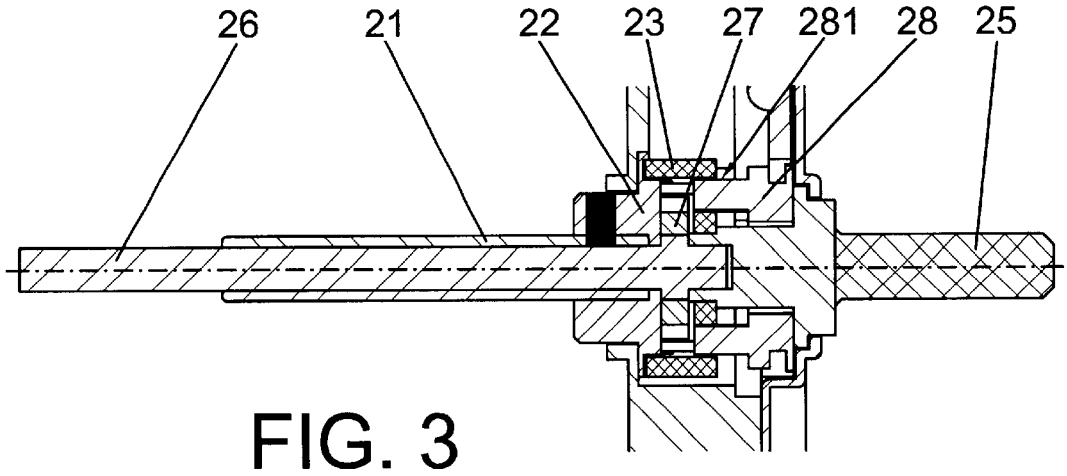
FIG. 3.—Is a cross-section of the mechanism when it is disengaged, taken along a plane containing the axis of the clutch.

In FIG. 3, which shows a cross-section of the mechanism when it is disengaged, it can be seen how the coupling piece 28 is in its most retracted position, so that the projections 281 do not fully traverse the inner follower 23 and do not touch the clutch element 27. Under these conditions, if the outer knob 5 is turned, the second shaft 26 and the clutch element 27 will both turn but they will not transmit any movement to the rest of the pieces.

Figure 4:
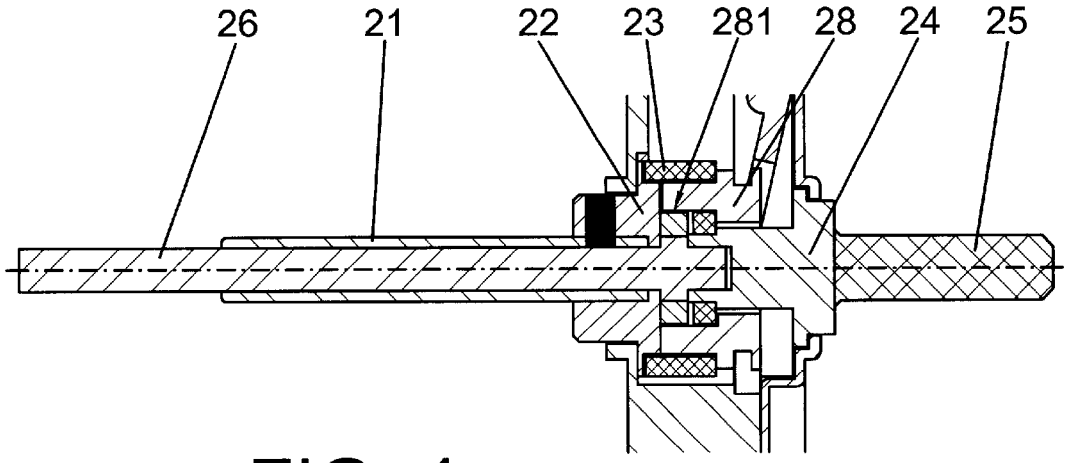
FIG. 4.—Is the same cross-section of FIG. 3, with the mechanism when it is engaged.

In FIG. 4, which shows the mechanism when it is engaged, we can see that the coupling piece 28 is in its most advanced position and its projections 281 fully traverse the holes 233 and project inside the four notches 232 of the clutch element 27, as well as inside the grooves 233 of the outer follower 22, causing both pieces (clutch element 27 and outer follower 22) to rotate as a unit.

Figure 5:
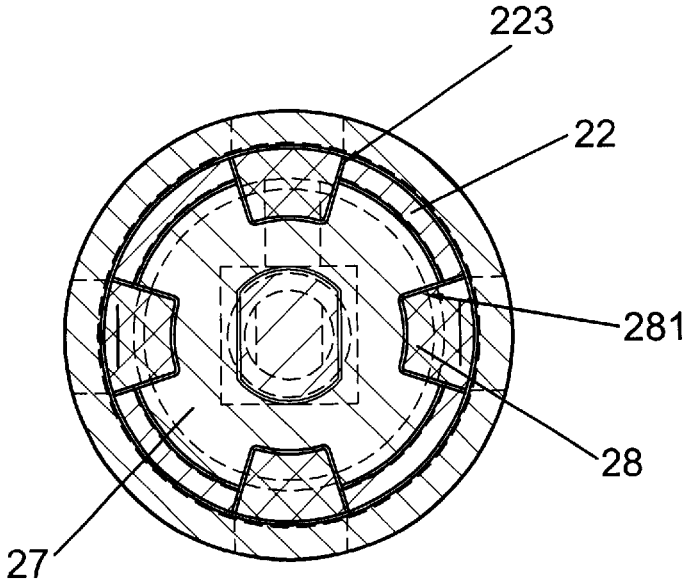
FIG. 5.—Is a cross-section of the mechanism when it is engaged, taken along a plane perpendicular to the axis of the clutch.

In the transverse cross-section of the mechanism as per FIG. 5, concerning the outer follower 22, clutch 27 and projections 281 of the collar or coupling piece 28, it can be seen how those pieces interact when engaged. Owing to the arrangement of the mechanism, the clutch points are in the outermost circle. The pieces can be made with a diameter as large as permitted by the width of the inner escutcheon 6 of the lock, so that the stress suffered by those pieces is thereby diminished.

Figure 6:
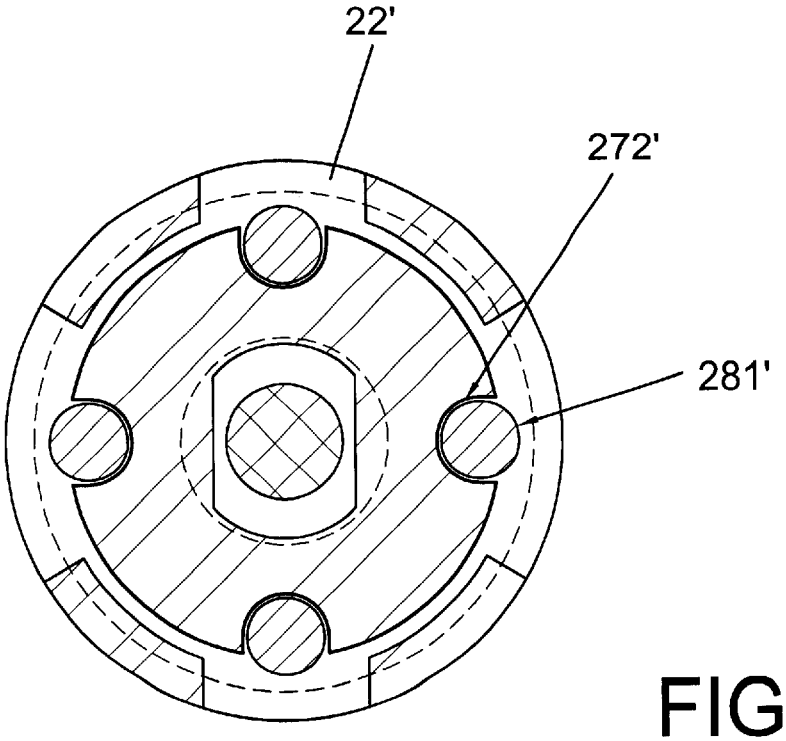
FIG. 6.—Is a transverse cross-section similar to FIG. 5, of a variant of an embodiment of the mechanism.
Figure 7:
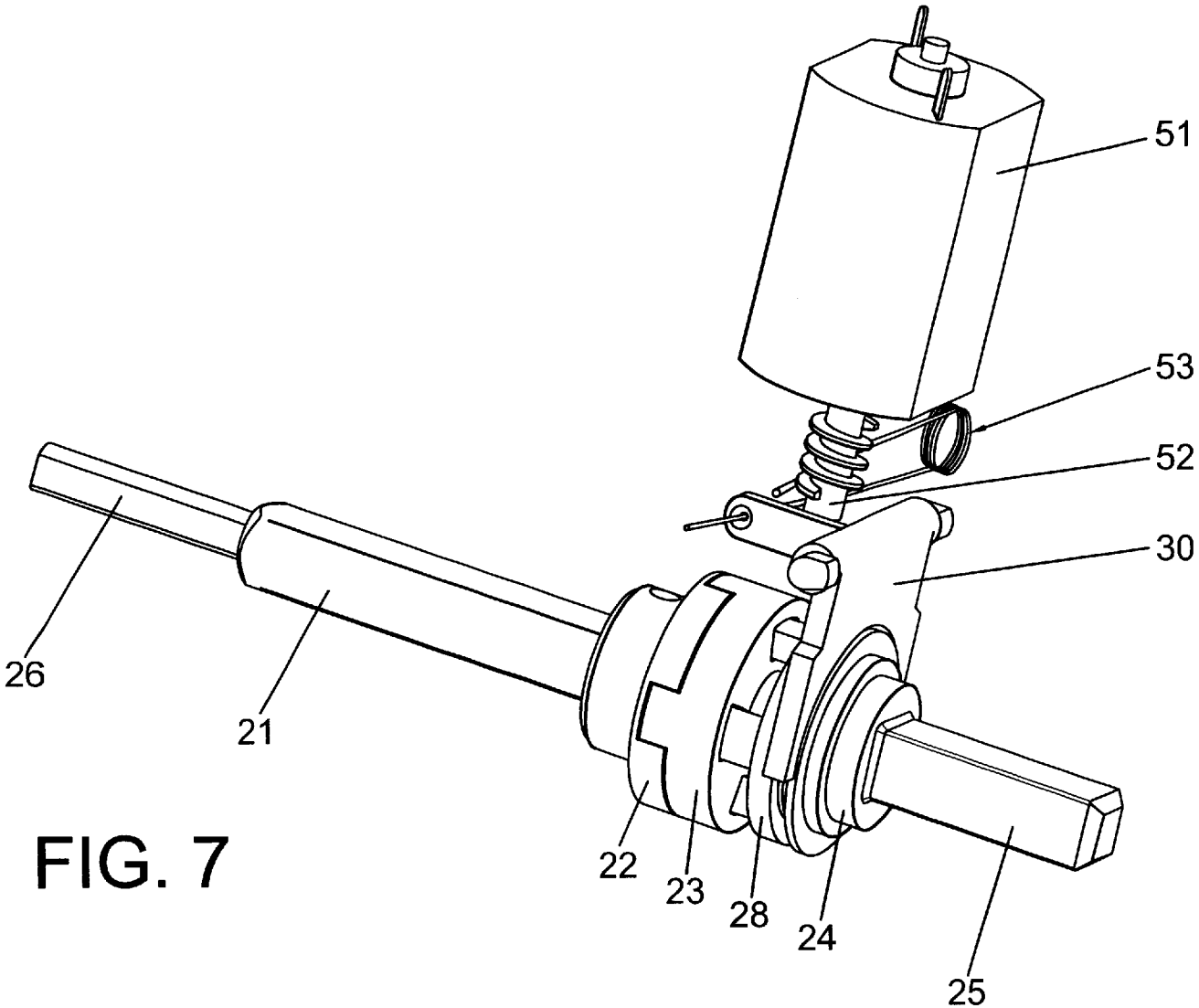
FIG. 7.—Is a perspective view of the clutch mechanism, with all pieces assembled, according to FIG. 2, excluding the box and the cover for the mechanism in order to enable those pieces to be visible.

FIG. 6 represents a variant way of embodiment in which the projections 281 have a rounded instead of a trapezoidal cross-section, as do the notches 272 of the clutch element 27, which have been referenced with the same numbers though primed. In this case the projections 281' do not interact with the outer follower 22, which is not necessary given that they traverse the holes 233 of the inner follower 23 and cause it to rotate integrally to the clutch 27, thereby producing the desired effect. The functioning principle is otherwise the same.

The embodiment shown in FIG. 5 has the advantage compared to that shown in FIG. 6 that the point of application of the stresses produced by the projections 281 on the clutch element 27 and on the grooves 223 of the outer follower 22 lie in the same plane and at very short distances, which is to the benefit of the performance of the system.

The design of FIG. 6 causes the projections 281' to suffer from bending forces because the points of application of the stresses against the clutch are in a plane different from the stresses against the inner follower. In any case, given the proximity of both planes, the bending forces are not very great. On the other hand, its manufacture can be cheaper since the shapes are simpler.

Other variants can be made by increasing the number of projections 281 or 281' to five, six or eight in order to reduce the rotation under no load prior to engage the clutch. Minor variations can also be made in the shapes of the pieces in order to facilitate their manufacture, or various of them can be grouped into a single piece such as the inner shaft 24 and the inner square bar 25, or a piece can be split up into several pieces.

It must also be noted that the clutch mechanism can be adapted to different types of lock, for example European mortise locks or American mortise locks or tubular locks provided they can be operated by means of a square bar. As we stated at the beginning of this description, the mechanism that the invention proposes can be adapted to the shaft actuating the lever or to the shaft actuating the catch bolt.

What is claimed is:

1. A clutch mechanism for electronic locks for minimising transmitted stresses, preventing premature wear, being able to be adapted to any lock, and minimising idle turning of a door aperture element selected from a handle and a outer knob, having an outer escutcheon which holds a key reader and an outer knob for actuation;

an inner escutcheon which holds an inner knob for actuation;

wherein the clutch mechanism is housed in the inner escutcheon;

the inner escutcheon comprises an electronic control circuit powered by batteries, and a clutch mechanism;

a first shaft and the second shaft project from the clutch mechanism, the first shaft and the second shaft are concentric, the first shaft acts on a tumbler of the lock, the second shaft freely rotates inside the first shaft and is partially inserted inside the outer knob rotating integrally with it;

the key reader is electrically connected to the control circuit so that when a valid key is presented, the control circuit supplies power to an electrical device, causing the clutch to engage, by making the concentric shafts temporarily integral and permitting the outer knob to open the lock.

2. A clutch mechanism for electronic locks, according to claim 1, wherein the first shaft is fixed to an outer follower which catches with an inner follower by means of complementary castellated projections, the outer follower and the inner follower shaping a cavity in which a clutch element integral to the second shaft freely rotates.

3. A clutch mechanism for electronic locks, according to claim 1, wherein an inner follower has a faceted axial opening in which an inner shaft integral with an inner square bar fits the first shaft, an outer follower, an inner follower, the inner shaft and the inner square bar, forms an integral rotating unit and are axially joined by means of a box and a cover where they are housed inside.

4. A clutch mechanism for electronic locks, according to claim 1, wherein an inner shaft has coaxially mounted with free rotational and axial movement a coupling piece provided with a plurality of axial projections that traverse an inner follower provided with a corresponding plurality of holes;

are housed in a plurality of notches of an outer follower;

are able to access a plurality of notches of a clutch element.

5. A clutch mechanism for electronic locks, according to claim 4, wherein the coupling piece has a cylindrical periphery portion with an annular groove in which two projections of a yoke are housed for enabling axial displacement of the coupling piece.

6. A clutch mechanism for electronic locks, according to claim 5, wherein the yoke oscillates around an axis and has a radial arm actuated by the electrical device.

* * * * *